US006229407B1

(12) United States Patent
Follet et al.

(10) Patent No.: US 6,229,407 B1
(45) **Date of Patent: *May 8, 2001**

(54) METHOD OF CONNECTING TWO LINEARLY-POLARIZED WAVEGUIDES, TRANSITION PLATE FOR THE CONNECTION, AND ASSEMBLY COMPRISING THE PLATE AND LOCKING MEANS

(75) Inventors: Thierry Follet; Christian Roger, both of Paris (FR)

(73) Assignee: Sagem SA, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/160,281

(22) Filed: Sep. 24, 1998

(30) Foreign Application Priority Data

Sep. 26, 1997 (FR) ..... 97 12002

(51) Int. Cl.[7] ..... H01P 1/165

(52) U.S. Cl. ..... 333/21 A; 333/157

(58) Field of Search ..... 333/21 A, 157, 333/125, 126, 135, 137

(56) References Cited

U.S. PATENT DOCUMENTS

| | | | | |
|---|---|---|---|---|
| 2,985,850 | * | 5/1961 | Crawford et al. | 333/137 X |
| 3,164,789 | * | 1/1965 | Grosbois et al. | 333/137 |
| 4,222,017 | * | 9/1980 | Foldes | 333/135 X |
| 4,260,961 | * | 4/1981 | Beis | 333/21 A |
| 4,755,777 | * | 7/1988 | Cohen et al. | 333/137 |

* cited by examiner

*Primary Examiner*—Benny Lee
(74) *Attorney, Agent, or Firm*—Greenberg Traurig LLP

(57) ABSTRACT

For the connection, a transition plate (11), for rotating the polarization of the waves leaving one (2) of the guides into an intermediate transition polarization, which is not parallel to the polarizations of the two guides, is inserted between the two waveguides (1, 2), the plate (11) is fixed to one (2) of the two waveguides and one end of the other waveguide (1) is introduced into a recess (12) for housing the transition plate (11).

3 Claims, 2 Drawing Sheets

METHOD OF CONNECTING TWO LINEARLY-POLARIZED WAVEGUIDES, TRANSITION PLATE FOR THE CONNECTION, AND ASSEMBLY COMPRISING THE PLATE AND LOCKING MEANS

FIELD OF THE INVENTION

This invention relates to a method of connecting two linearly-polarized waveguides for guided wave transmission. and to a transition plate for connecting said linearly-polarized waveguides.

BACKGROUND OF THE INVENTION

In the field of data transmission by radio beams, the radio-wave transmitters and receivers generally comprise a radio cabinet incorporating a modulator and a demodulator, a radio antenna connected to the radio cabinet and a management cabinet comprising a multiplexer and a management microcontroller connected to the radio cabinet.

In order to connect the radio antenna to the radio cabinet, the antenna and the cabinet each comprise a connecting waveguide provided at its free end with a fixing flange. The polarization of the connecting waveguides is generally either horizontal or vertical.

In order to connect two waveguides having the same two polarization directions, all that is required is to connect the two waveguides directly by fastening their fixing flanges together.

On the other hand, if the polarization directions of the two connecting waveguides are different, respectively vertical and horizontal, it is necessary to modify the polarization direction between the two connecting waveguides. For example, it is possible to use a coaxial cable or to insert a flexible waveguide between the antenna and the radio cabinet and twist the flexible waveguide into a twisted waveguide.

However, the use of flexible waveguides, which inordinately extends the distance of the antenna from the radio cabinet, significantly increases the losses.

In order to connect the antenna to the radio cabinet, while bringing them as close together as possible, it is conceivable to connect the antenna directly to the cabinet by rotating them through 90°, one with respect to the other. In this case, the waveguide for connecting the antenna or the radio cabinet must comprise two different fixing systems.

However, the fixing flanges of standard connecting waveguides often provide fixing holes placed in the form of a rectangle, for indexing, and therefore do not allow various orientations of the flanges when fixing them.

A twisted waveguide, intended to be inserted between the radio antenna and the radio cabinet, before use, so as to convert a vertical linear polarization into a horizontal linear polarization, or vice versa, is also known.

In this case, after the twisted waveguide has been installed, the radio antenna can no longer be subsequently replaced by a new antenna having a polarization direction identical to that of the radio cabinet unless the twisted waveguide is removed.

The invention is therefore based on a problem of connection between a radio antenna and a radio cabinet. However, the Applicant does not mean to limit the scope of its application to this particular example but, on the contrary, to extend it to any connection of two devices for a guided wave transmission such as between an upstream transmitter and a downstream connection between a downstream receiver and an upstream connection, etc.

U.S. Pat. No. 2,729,794 teaches a device for connecting two waveguides which comprises a diaphragm inserted between the two waveguides and provides a straight slot inclined at 45° with respect to the polarization directions of each of the two waveguides. This diaphragm acts as means of rotation which are intended to rotate the polarization of the waves leaving one of the two waveguides. Here, the Applicant has sought to make the means of rotation have another function so as to make the two waveguides easier to connect.

SUMMARY OF THE INVENTION

For this purpose, the invention relates to a method of connecting two linearly-polarized waveguides for guided wave transmission, wherein means for rotating the polarization of the waves leaving one of the guides into an intermediate transition polarization, which is not parallel to the polarizations of the two guides, are inserted between the two waveguides, wherein the means of rotation are fixed to one of the two waveguides and one end of the other waveguide is introduced into a recess for housing the means of rotation.

The invention also relates to a transition plate for connecting two linearly-polarized waveguides, for the implementation of the above method, comprising a straight wave-transit slot and fixing means designed to fix the slot to the two waveguides, in at least two different relative positions compatible with the orientation of the slot in the transition plate.

Advantageously, the means for fixing the two waveguides include means for indexing one of the two waveguides and means for fixing the other waveguide in two different positions.

Preferably, the means for fixing said other waveguide comprise a housing recess intended to house a fixing flange in two positions rotated approximately 90° one with respect to the other.

By virtue of this arrangement, it is possible to connect commercially available waveguides with the usual fixing flange.

The invention also relates to an assembly comprising a transition plate as defined above and locking means, wherein the transition plate provides a plurality of holes for housing screws for fixing the locking means, these being intended to lock the fixing flange of said other waveguide in the recess in the transition plate.

The invention will be more clearly understood with the aid of the following description of one particular way of implementing the method of connection of the invention and of one particular embodiment of the transition plate for the implementation of the method, with reference to the appended drawing in which:

DETAILED DESCRIPTION OF THE INVENTION

Figure 2:
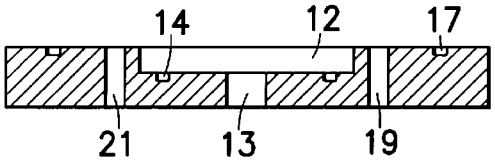
FIG. 2 shows a sectional view of the transition plate of FIG. 1, along the line II—II thereof.
Figure 3:
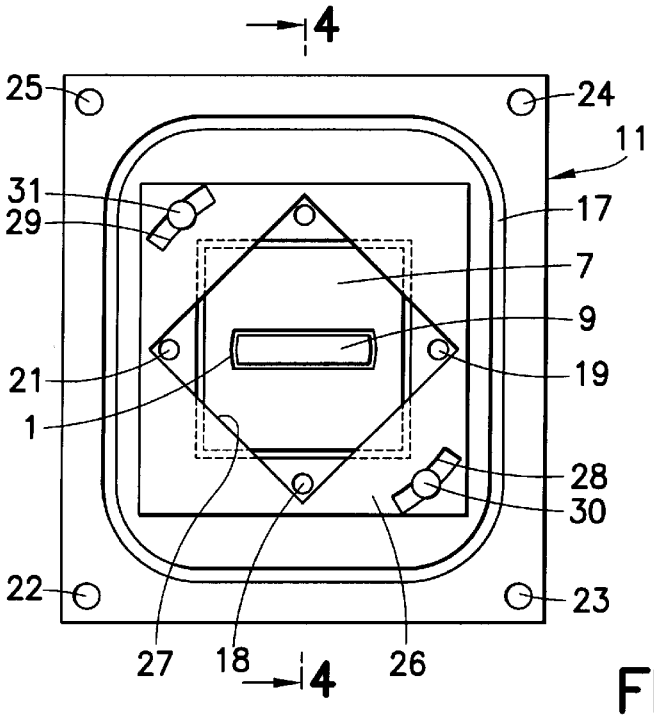
FIG. 3 shows a front view of the transition plate of FIG. 1 with a locking plate fixed to two waveguides.
Figure 4:
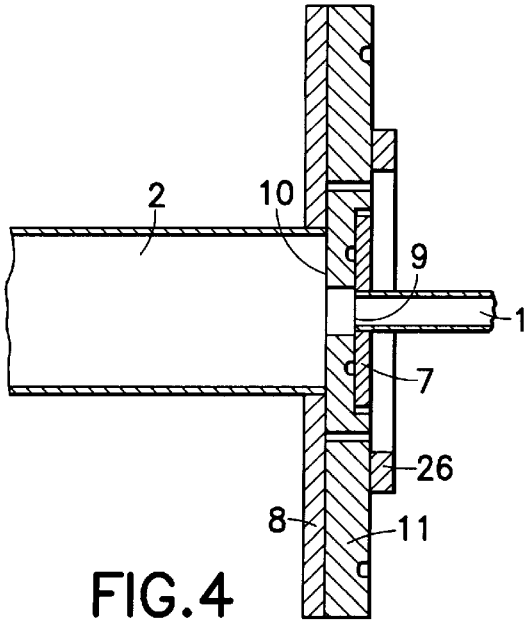
FIG. 4 shows a sectional view of the transition plate of FIG. 3, along the line IV—IV thereof.
Figure 6:
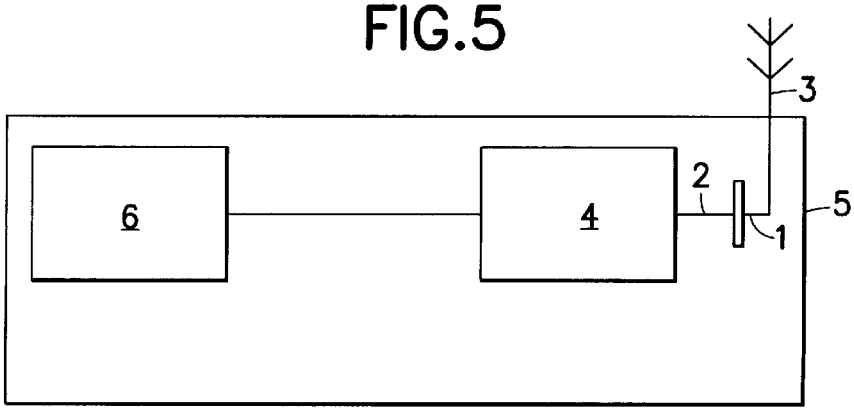
FIG. 6 shows a functional block diagram of a transmission and reception device comprising the two waveguides of FIG. 3.

The method of connection of the invention is intended to connect two waveguides 1, 2 shown in FIGS. 4 and 6 between which is interposed a transition plate 11, shown in FIGS. 1, 2, 3 and 4 or "rotation" plate, intended to rotate the polarization of the waves leaving one of the waveguides 1, 2.

The two waveguides 1, 2 respectively leave a radio antenna 3 and a radio cabinet 4, both shown in FIG. 6 also called an "outdoor cabinet", and each has an external end provided with a fixing flange 7, 8 shown in FIG. 4 for connecting the radio antenna 3 to the radio cabinet 4.

The "outdoor cabinet" 4 and the radio antenna 3 form part of a radio transmission and reception device 5, shown in FIG. 6, furthermore comprising an "indoor cabinet" 6 shown in FIG. 6 which incorporates here a multiplexer and a management microcontroller.

The fixing flanges 7, 8 are of the square standard type and each comprises four fixing holes arranged in the four corners of a rectangle provided for indexing the fixing arrangement. A straight wave-transit slot 9, 10 shown in FIGS. 3 and 4, respectively, extends at the center of each indexing rectangle parallel to two of the sides of the rectangle.

The waveguides 1, 2 of the radio antenna 3 and of the radio cabinet 4 have here a horizontal and vertical linear polarization, respectively.

It should be emphasized that the horizontal and vertical directions of the polarizations of the waveguides 1, 2 are defined with respect to the orientation of the rectangles for indexing the respective fixing flanges of the waveguides.

Figure 1:
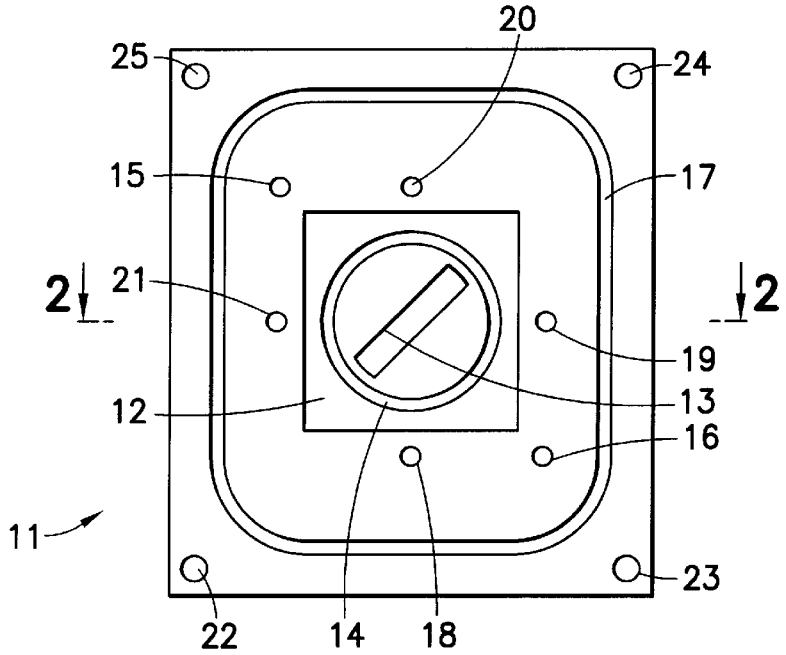
FIG. 1 shows a front view of the particular embodiment of the transition plate of the invention.

The transition plate 11, which here is of rectangular shape, provides in its front face a recess 12 shown in FIGS. 1 and 2 for housing the fixing flange 7 of the waveguide 1 of the radio antenna 3.

The housing recess 12 has a square section, of side equal to the side of the fixing flange 7 of the radio antenna 3, and a depth approximately equal to the thickness of this fixing flange 7. A wave-transit slot 13 shown in FIGS. 1 and 2 extends along the diagonal of the bottom of the housing recess 12.

It should be emphasized that, since the section of the recess 12 is square, the fixing flange 7 of the radio antenna 3 may be introduced in two different positions, rotated through 90° one with respect to the other, and both positions being compatible with the orientation of the slot 13 in the transition plate 11, as will be explained in the description of the way in which the two waveguides 1 and 2 and the transition plate 11 are mounted.

An approximately circular internal groove 14, shown in FIGS. 1 and 2 for housing an O-ring seal, surrounds the wave-transit slot 13.

Two holes 15, 16 shown in FIG. 1 for fixing a locking plate 26 shown in FIG. 3 of the waveguide 1 of the radio antenna 3 are provided through the transition plate 11, these being diagonally opposed on each side of the housing recess 12.

The locking plate 26, intended to lock the fixing flange 7 of the waveguide 1 of the radio antenna 3 in the housing recess 12, here is square and of side slightly greater than the diagonal of the fixing recess 12. An opening 27, shown in FIG. 3 of square shape and of side equal to that of the fixing flange 7 of the radio antenna 3, is provided through the locking plate 26, the diagonals of the opening 27 extending parallel to the edges of the locking plate 26. The opening 27 is intended to release the fixing flange 7 by rotating the plate 26. Furthermore, two openings 28, 29, shown in FIG. 3, in the shape of circular arcs, intended to house fixing screws 30, 31 shown in FIG. 3 for fixing the locking plate 26 to the transition plate 11, extend near two parallel sides of the opening 27.

Figure 5:
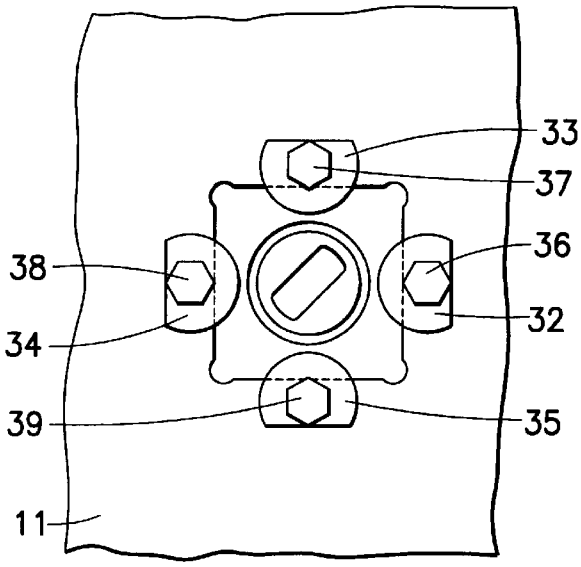
FIG. 5 shows a front view of the transition plate of FIG. 1 with locking washers.

The transition plate 11 provides four other holes 18, 19, 20, 21 shown in FIGS. 1 and 3 for fixing the waveguide 1 of the radio antenna 3, these lying near the middle of each side of the fixing recess 12. These four holes 18–21 are intended to house four fixing screws 36, 37, 38, 39 shown in FIG. 5 for fixing four locking washers 32, 33, 34, 35. Each locking washer 32–35 shown in FIG. 5 has a straight cut edge in order to release the fixing flange 7 of the radio antenna 3 by rotating the washers 32–35.

An external peripheral groove 17 shown in FIGS. 1 and 2 for housing an O-ring seal extends near the perimeter of the transition plate 11, on the front face side.

Finally, the transition plate 11 provides, at the four corners of a peripheral rectangle, four holes 22, 23, 24 25 shown in FIGS. 1 and 3 for fixing and indexing the waveguide 2 of the radio cabinet The way in which the transition plate 11 and the two waveguides 1, 2 are mounted, corresponding to the method of connecting the two waveguides 1, 2, will now be described.

In order to fix the transition plate 11 to the fixing flange 8 of the radio cabinet 4, while at the same time indexing the transition plate 11, the rear face of the transition plate 11 is pressed against the fixing flange 8 of the radio cabinet 4, making the four peripheral holes 22–25 of the transition plate 11 come into correspondence with the four fixing holes of the fixing flange S. The transition plate 11 and the fixing flange 8 are then screwed together.

After the transition plate 11 has been mounted on the radio cabinet 4, the wave-transit slot 13 in the transition plate 11 makes an angle of 45° with the wave-transit slot in the fixing flange 8 of the radio cabinet 4. Such a relative orientation of these two adjoining wave-transit slots makes it possible to rotate the vertical polarization of the waves leaving the waveguide 2 of the radio cabinet 4 into an intermediate transition polarization located through 45° with respect to the vertical.

Next, the fixing flange 7 of the horizontally-polarized waveguide of the radio antenna 3 is introduced into the housing recess 12, orienting the wave-transit slot in the fixing flange 7 so as to be perpendicular to the wave-transit slot in the fixing flange 8 of the vertically-polarized waveguide 2 of the radio cabinet 4. The wave-transit slot in the fixing flange 7 is thus rotated by 45° with respect to the wave-transit slot 13 in the transition plate 11.

Such a relative orientation of the wave-transit slots 9, 10, 13, is intended to rotate the horizontal polarization of the waves leaving the waveguide 2 of the radio cabinet 4 into an intermediate transition polarization and then into a horizontal polarization.

The locking plate 26 is pressed against the transition plate 11, by rotating locking plate 26 so that it locks the four corners of the fixing flange 7 in the housing recess 12. The locking plate 26 is then screwed against the transition plate 11, by means of the screws 30, 31.

It would also be possible to lock the fixing flange 7 in the housing recess 12 by means of the locking washers 31–35.

In this case, the locking washers 31–35 are screwed to the transition plate 11, locking the fixing flange 7 in the housing recess 12.

It should be emphasized that during the connection operation, the transition plate 11 is inserted between the two waveguides 1, 2, thereby fixing it to the waveguide 2 of the radio cabinet 4 in order to rotate the polarization of the waves leaving the waveguide 2 into an intermediate transition polarization rotated by 45° with respect to each of the polarizations of the two waveguides 1, 2.

In order to change the horizontally-polarized radio antenna 3 for another radio antenna provided with a vertically-polarized connecting waveguide, the fixing flange 7 is released by slightly unscrewing the plate 26 and rotating it so that the fixing flange 7 passes through the passage opening 27.

If the locking washers 32–35 are used, they are slightly unscrewed and then rotated so as to release the fixing flange 7.

After the waveguide 1 of the radio antenna 3 has been unfastened from the radio cabinet 4/transition plate 11 assembly, the fixing flange of the vertically-polarized waveguide of the new radio antenna is introduced, by orienting the wave-transit slot in this new waveguide so as to be parallel to the wave-transit slot in the waveguide 2 of the radio cabinet 4 before the new flange is locked in the recess 12, as described above. The wave-transit slots in the two waveguides of the radio antenna and of the radio cabinet 4, respectively, are thus inclined at 45° with respect to the wave-transit slot in the transition plate 11 inserted between the two waveguides. Such a relative orientation of the three wave-transit slots makes it possible to rotate the waves leaving the waveguide 2 of the radio cabinet 4 into an intermediate polarization rotated by 45° with respect to the polarizations of the two waveguides and then into the vertical polarization of the waveguide of the new radio antenna.

In the above description, the transition plate is fixed to the waveguide whose polarization has to be rotated and one end of the other waveguide is introduced into the housing recess of the transition plate. However, it would be possible to fix the transition plate to either of the two waveguides to be connected and to introduce one end of the other waveguide into a housing recess in the transition plate.

What is claimed is:

1. A transition plate for connecting two waveguides capable of supporting linear polarization, each said waveguide having a respective polarization direction, wherein said respective direction is one selected from a horizontal linear polarization and a vertical linear polarization, said transition plate comprising a straight wave-transit slot and fixing means designed to fix the transition plate with respect to the two waveguides in at least two different relative positions, each said position permitting guided wave transmission through the wave transit slot in the transition plate, in order to rotate the corresponding polarization of the waves leaving one of the two waveguides into an intermediate transition polarization between the respective polarization of the two waveguides, and wherein the means for fixing said other one of said two waveguides comprises a recess in the transition plate configured and adapted for housing a flange on said other waveguide in two positions rotated approximately 90° one with respect to the other.

2. The transition plate as claimed in claim 1, wherein the fixing flange has a square section and the recess for housing the flange has the same square section.

3. A transition plate for connecting two waveguides capable of supporting linear polarization, each said waveguide having a respective polarization direction, wherein said respective direction is one selected from a horizontal linear polarization and a vertical linear polarization, said transition plate comprising a straight wave-transit slot and fixing means designed to fix the transition plate with respect to the two waveguides in at least two different relative positions, each said position permitting guided wave transmission through the wave transit slot in the transition plate, in order to rotate the corresponding polarization of the waves leaving one of the two waveguides into an intermediate transition polarization between the respective polarization of the two waveguides, wherein the means for fixing the two waveguides include means for indexing one of the two waveguides and means for fixing the other of the two waveguides in two different positions, and wherein the means for indexing said other waveguide comprise holes for the passage of fixing screws, said holes defining the corners of a rectangle.

* * * * *